US009511414B2

(12) United States Patent
Levey

(10) Patent No.: US 9,511,414 B2
(45) Date of Patent: Dec. 6, 2016

(54) THREAD FORMING DIE AND METHOD

(75) Inventor: Kenneth R. Levey, West Chicago, IL (US)

(73) Assignee: Illinois Tool Works Inc., Glenview, IL (US)

( * ) Notice: Subject to any disclaimer, the term of this patent is extended or adjusted under 35 U.S.C. 154(b) by 381 days.

(21) Appl. No.: 13/696,387

(22) PCT Filed: Jul. 13, 2011

(86) PCT No.: PCT/US2011/043856
§ 371 (c)(1),
(2), (4) Date: Nov. 6, 2012

(87) PCT Pub. No.: WO2012/009439
PCT Pub. Date: Jan. 19, 2012

(65) Prior Publication Data

US 2013/0051954 A1 Feb. 28, 2013

Related U.S. Application Data

(60) Provisional application No. 61/364,057, filed on Jul. 14, 2010.

(51) Int. Cl.
*B21H 3/06* (2006.01)

(52) U.S. Cl.
CPC ..... *B21H 3/06* (2013.01)

(58) Field of Classification Search
CPC ..... B21H 3/06
(Continued)

(56) References Cited

U.S. PATENT DOCUMENTS 4,610,154 A * 9/1986 Carene, Jr. ..... B21D 17/02 72/88
4,633,696 A * 1/1987 Murayama et al. ..... 72/88
(Continued)

FOREIGN PATENT DOCUMENTS

DE 102010000084 A1 * 7/2011
GB 581249 A * 10/1946 ..... B21H 3/06
GB 581249 A * 10/1946

OTHER PUBLICATIONS

"Formulas for Cutting and Measuring Threads" by Jack Williams published in American Machinist vol. LVII on Dec. 31, 1922 p. 925-926.*

(Continued)

*Primary Examiner* — Edward Tolan
*Assistant Examiner* — Peter Iannuzzi
(74) *Attorney, Agent, or Firm* — Joseph M. Butscher; The Small Patent Law Group, LLC

(57) ABSTRACT

A die for roll forming threads on a cylindrical blank includes a planar die body having a longitudinally elongate working face of sufficient length for the blank to make multiple revolutions across the face. A plurality of thread forming elements on the face. The thread forming elements are spaced apart longitudinally of the die working face an ever increasing distance, based on the actual rolling diameter of the blank with the spacing between the thread forming elements at the start end equal to the diameter of the blank and the spacing between the thread forming elements at the finish end equal to eighty-five percent of the final diameter of the thread formed on the blank. The thread forming elements on the working face of the die are equally spaced apart in a direction perpendicular to the longitudinal extent of the working face.

5 Claims, 8 Drawing Sheets

(58) Field of Classification Search
USPC .. 72/88, 90, 20.1–21.5, 302, 422; 470/8–10, 84, 204
See application file for complete search history.

(56) References Cited

U.S. PATENT DOCUMENTS

| | | | | |
|---|---|---|---|---|
| 4,683,743 | A * | 8/1987 | Fitzpatrick | B21H 5/027 72/70 |
| 2002/0112524 | A1* | 8/2002 | Caton | B21H 3/06 72/469 |
| 2003/0156921 | A1* | 8/2003 | Nagawa | F16B 39/30 411/411 |
| 2005/0238459 | A1 | 10/2005 | Levey et al. | |
| 2011/0085867 | A1* | 4/2011 | Ellis | B23G 7/02 408/222 |
| 2012/0309548 | A1* | 12/2012 | Hettich | B21H 3/06 470/10 |

OTHER PUBLICATIONS

An International Search Report, dated Oct. 21, 2011, issued in International Application No. PCT/US2011/043856.

* cited by examiner

FIG. 1
(PRIOR ART)
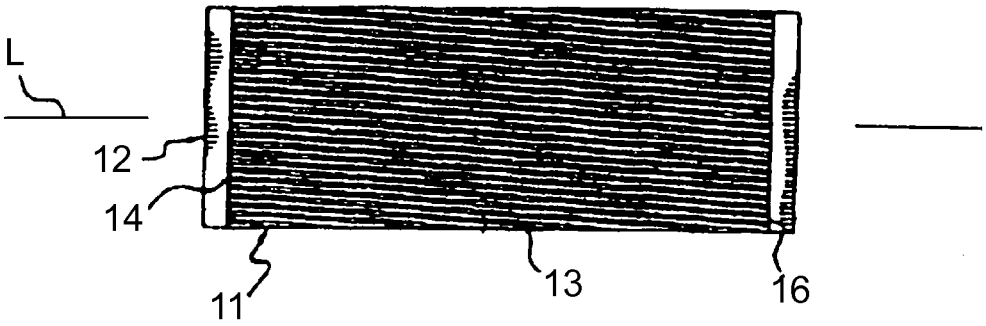
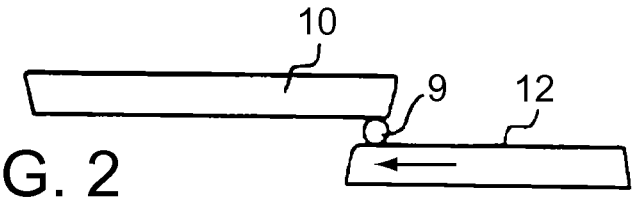
FIG. 2
(PRIOR ART)
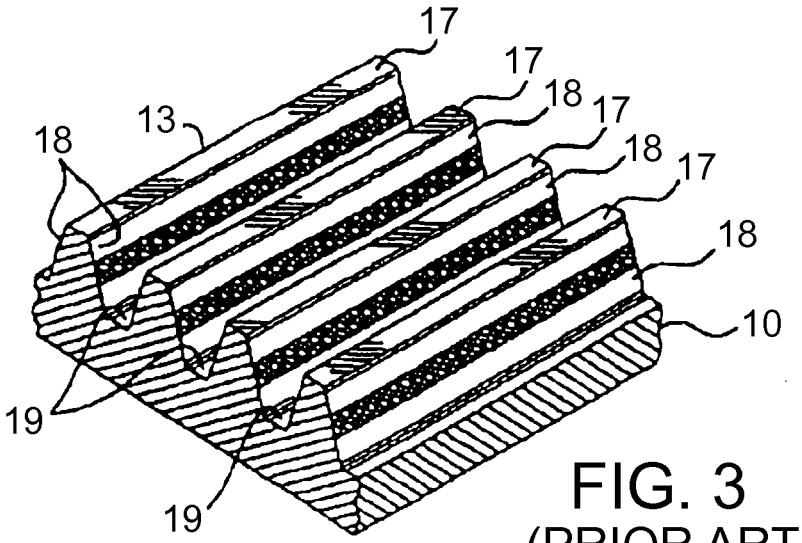
FIG. 3
(PRIOR ART)

Constant Transverse Pitch
(Conventional Dies)

THREAD FORMING DIE AND METHOD

RELATED APPLICATIONS

This application is a National Stage of International Application No. PCT/US2011/043856, filed Jul. 13, 2011 and claims priority pursuant to Title 35 USC §119 to U.S. Provisional Application No. 61/364,057, filed Jul. 14, 2010.

BACKGROUND

This invention relates to the manufacture of threaded fasteners and, more particularly, to the dies for roll forming threads on the male fastener element, to associated method and to the resultant threaded article.

Threaded fasteners are widely used to connect separate components and are employed in myriad applications. Such fasteners typically include a threaded male member comprising a cylindrical body or shank with a roll formed thread on its exterior. An example of a fastener with roll formed threads is disclosed in U.S. Pat. No. 7,326,014 entitled "Interactive Fit Screw Thread."

A common method for manufacture of male threaded fastener elements is to employ roll form dies to create the threads on the cylindrical body or blank. Multiple revolutions of the blank are employed to progressively deform the blank material to fully form the thread crests and roots. Thus, with each revolution of the blank, partial metal deformation occurs. Generally the greater the thread depth, the more revolutions of the blank are required to complete the final thread form.

In a standard thread roll die, multiple straight, angled lines are provided to enable the formation of a helical thread. Two dies are provided, one that is stationary and one that moves linearly with respect to the non-moving die. The movement of the moveable die with respect to the stationary die causes the screw blank to rotate and advance along the die surfaces. As the blank rotates, the threads begin to form.

Existing flat thread rolling tooling available is manufactured with the thread form following a straight line. All current manufacturing processes are built around cutting and grinding shapes into tooling based on straight lines.

It is generally desirable for the blank to be realigned with the dies upon each rotation. This means that, at the start of the forming process, the blank is located in a certain position with respect to the thread rolling forms (lines) and upon each complete rotation, is positioned in the same position (albeit offset from the original starting point) with respect to the thread forms. In this way, as the helical thread is formed, the thread will be uniform without deformations being formed thereon. Also, if the thread forms are aligned upon each rotation, less wear and damage will occur to the thread forms.

During the manufacture of some fasteners, it was noted that deformations were being created on the threads. The deformations are not insignificant given the importance of, for example, the wavy thread form of the fastener shown in U.S. Pat. No. 7,326.014.

SUMMARY OF THE INVENTION

The invention is based on the discovery, when a screw is manufactured using flat tooling, the diameter the screw rolls through the tooling changes. All machine screw forming starts rolling at the initial diameter and finishes rolling at a larger diameter. That is, the actual rolling diameter increases. This means the thread form on the die should not follow a straight line. It should follow changing angles, or a curve.

In the present invention, the thread forming elements on the working faces of the dies are longitudinally spaced apart a distance based upon the ever increasing diameter of the blank as it travels between the working faces of the dies.

DESCRIPTION OF DRAWINGS

FIG. 1 is a plan view of a prior art thread forming die;

FIG. 2 is a side schematic view of a prior art set of thread forming dies;

FIG. 3 is a fragmentary perspective view of the prior art thread forming die of FIG. 1;

DESCRIPTION OF ILLUSTRATED EMBODIMENTS

Figure 4:
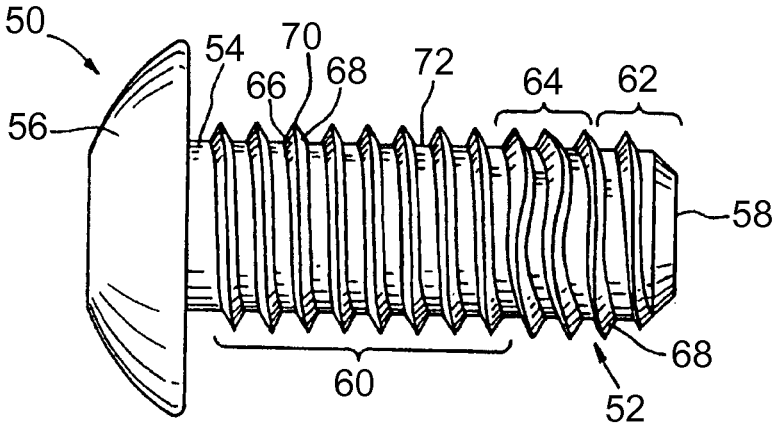
FIG. 4 (PRIOR ART)
FIG. 4 is a plan view of a threaded fastener made by roll forming.

Turning now to the drawings, a typical fastener 50 illustrated in FIG. 4 has a thread 52 on shank 54. A head 56 and distal tip 58 are provided on opposite ends of shank 54. Thread 52 includes a standard straight-line thread path portion 60 near head 52 and a standard straight-line thread path portion 62 near distal tip 58. An intermediate thread portion 64 including three helical revolutions of thread 52 follows a curved thread path within the helical pattern. Thread 52 includes a pressure flank 66 and a trailing flank 68 between a thread crest 70 and a thread root 72, all of which follow substantially straight-line paths through portions 60 and 62 and follow a curved-line path through curved-line portion 64.

Fastener 50 can be made in a variety of sizes and general helical thread pitches as needed for given applications. Numerous variations in fastener configurations exist. The fastener of FIG. 4 is merely one example where threads are conveniently formed in a roll forming process.

Regarding nomenclature, in a single pitch thread, the axial distance between adjacent threads is the axial pitch of the thread to be formed (Pa). That is, axial pitch is the axial distance along a fastener shank portion between the same point on adjacent threads.

Transverse pitch ($P_t$) is the linear distance or path length of one revolution of the thread helix. According to industry standard, transverse pitch is deemed to be based on the diameter of the starting blank, or shank of the fastener. The axial length is the constant pi (3.14159) multiplied by the diameter of the blank ($P_t=\pi d_b$). It is, therefore, the circumference of the blank.

FIGS. 1, 2 and 3 illustrate an example of a process for forming a thread on a cylindrical blank and associated tooling employed. The fastener blank 9 is interposed between a pair of thread rolling dies 10, 12. The arrangement comprises a moving die 12 while the second one of the thread rolling dies 10 is a stationary die.

As best seen in FIGS. 1 and 3, each one of the thread rolling dies 10, 12 comprises a tool steel body 11 having a generally planar longitudinally elongate working face. The working face is provided with a plurality of die threads 13 which extend from a start end 14 of the thread rolling die toward a finish end 16 of the thread rolling die, and which are disposed at a predetermined angle with respect to the axial or longitudinal extent or axis L of the thread rolling die in order to form the threads upon the blank 9. During the thread forming process, the blank 9 makes several complete revolutions or rolls from the start end to the finish end.

As the blank member 9 is rolled between the two thread rolling dies 10, 12 from the start end 14 toward the finish end 16, the material comprising the blank member 9 is progressively displaced and flows into or between the thread rolling die threads 13 whereby fully formed threads, which mate with or correspond to the thread rolling die threads 13 of the thread rolling dies 10, 12, are produced upon the blank member 9.

More particularly, as can best be appreciated from FIG. 3, each one of the thread rolling die threads 13 comprises a plurality of crest portions 17, which are adapted to penetrate the blank member material during the thread rolling operation so as to effectively and ultimately form the root portions of the threads upon the blank member 9. A plurality of root portions 19 on the thread rolling dies are adapted to ultimately form the crest portions of the threads upon the blank member 9 at the completion of the thread rolling operation.

Flank portions 18 of the thread rolling die threads 13 define surfaces along which the blank member material flows during the formation of the crest and root portions of the threads upon the blank member 9. The flank portions 18 of the thread rolling die threads 13 likewise form corresponding thread flank portions upon the blank member 9. It is further noted that as the rolling process proceeds, the material comprising the blank member continues to be displaced along the flank portions 18 of the thread rolling die threads 13 with the depth of penetration increasing as the rolling process continues until a fully formed thread is produced upon the blank member 9 at the finish ends 16 of the thread rolling dies 10 and 12.

It is important to understand that the spacing between the opposing die faces is not parallel. At the start end 14, the faces at crest portions 17 are spaced apart a distance that is the same as the nominal (design) diameter of the starting blank. The faces as defined by the crests 17 are progressively closer together and reach a minimum spacing at the finish end of the die travel when finish ends 16 are facing each other. This latter spacing is determined such to ensure full deformation of the blank material into the desired thread form.

The die threads on the working face of the thread rolling dies, for example such as the thread rolling dies of FIGS. 1 and 3, are laid out in a pattern such that as the fastener blank is rotated between the die faces, treads are created in the blank by the thread pattern on the working faces of the thread rolling dies. The spacing of the threads between adjacent thread forms along the vertical or X axis of the die face is equal to the thread axial pitch ($P_a$). Conventionally, the spacing of the die thread forms along the "Y" axis is equal to the transverse pitch ($P_t$). The "Y" axis extends the longitudinal extent of the working face of the die and the "X" axis extends perpendicular to the "Y" axis. This relationship, for the fastener illustrated in FIG. 4 is illustrated in FIG. 5, which shows the working face of one die.

Figure 5:
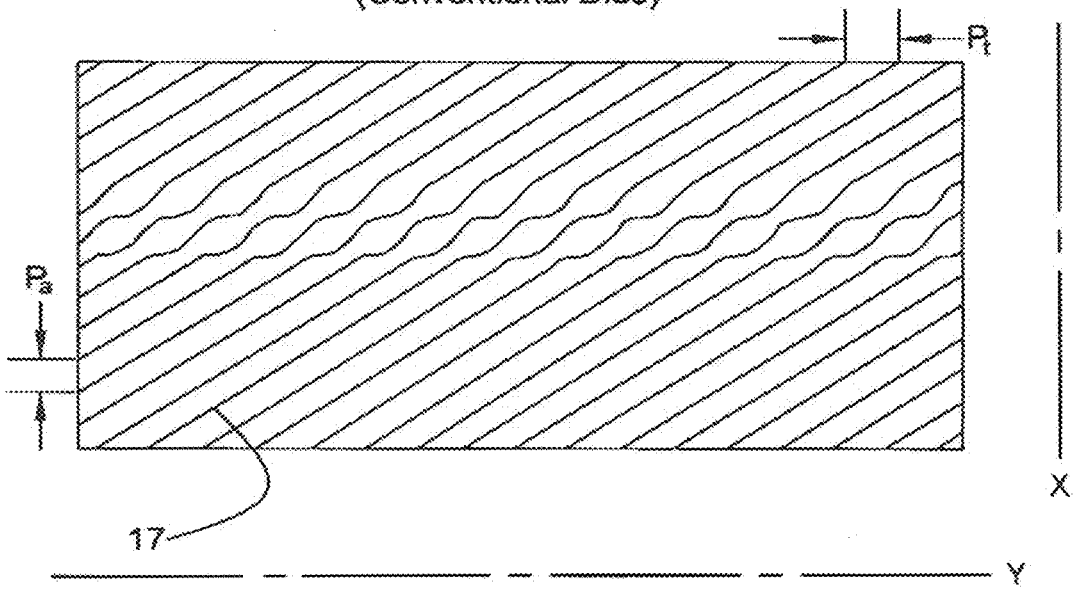
FIG. 5 (PRIOR ART)
FIG. 5 is a plan view illustrating the face of a prior art thread form die.

The die face of FIG. 5 shows a multiplicity of thread forming elements such as crests 17 spaced apart along the "X" axis a distance Pa, equal to the pitch of the thread being formed in the fastener blank. The thread pattern is disposed and shaped to transfer the thread pattern to the blank as it completes several revolutions or rolls between the die faces. The spacing of the thread forming elements along the longitudinal extent, or the "Y" axis, of the die working face is the transverse pitch of the blank $P_t$. The pattern illustrated includes a wavy portion to create the curved-line thread portion 64. The thread forms on the die faces for the areas 60 and 62 are straight.

It should be noted that the particular shape of the die thread pattern of FIG. 5 is one that in operation forms a thread pattern such as disclosed in the fastener of U.S. Pat. No. 7,326,014. This die configuration is merely exemplary and the principles discussed here are considered applicable to all thread forming dies.

Figure 6:
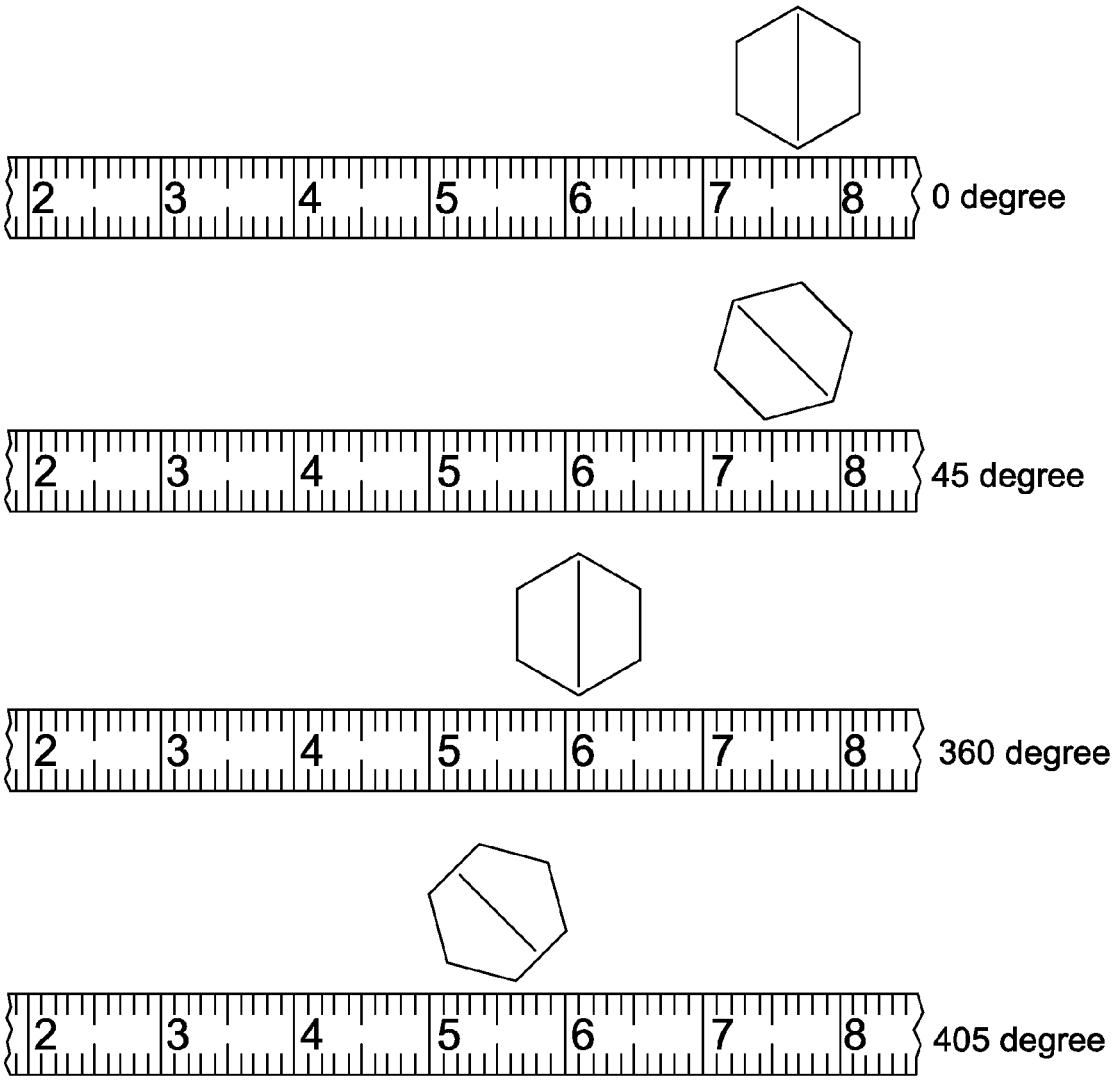
FIG. 6 is a group of high speed photographs illustrating the movement of a fastener blank through a set of thread forming dies.

The spacing described above presumes that the blank rolls between the die faces at the original blank diameter. Based on such an assumption, one revolution, or roll, of the blank between the die faces, would cause the blank to rotate a distance to cause the blank to advance a distance equal to one transverse pitch ($P_t$). Experimentation has revealed, however, that in actual production of threaded fasteners such is not the case. Studies of how thread rolling tooling works using high speed video, using M3-M16 screws confirms that rolling diameter of a screw increases during the forming process. In other words, blank diameter does not remain constant and hence the diameter at which the blank rolls through the die faces does not remain constant. Illustrated in FIG. 6 are high speed photographs showing the actual rotational movement of a fastener blank during a multiple rotation thread forming operation.

So, when designing roll die face patterns, using a constant blank diameter, upon each rotation of the screw blank, alignment will not occur. This is evidenced in the high speed photos of FIG. 6 illustrating the disparity described.

Such deformations in regard to standard threads have not presented significant problems. However, the die configuration of the present invention is considered beneficial to standard thread forms as the dies should now last longer as the thread forms more properly line up during the forming process.

Upon analysis, of the change occurring with each rotation, it was determined that the amount of distance traveled increased. In other words, as the rolling diameter increased, the distance to travel one revolution increased because the screw diameter has increased.

Figure 8:
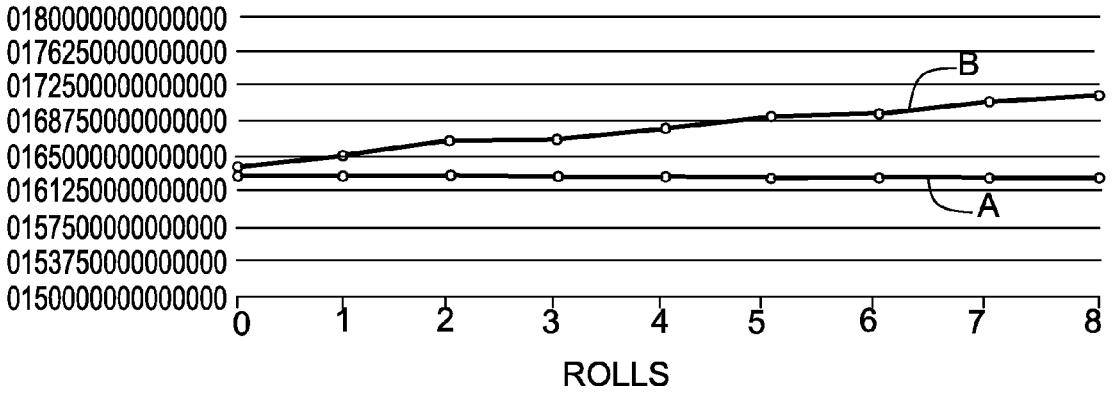
FIG. 8 is a chart comparing the transverse diameter of a prior art thread form die and the thread form die of the present disclosure.

The graph FIG. 8 shows the actual data taken. The line "A" illustrates the conventional layout where transverse pitch remains constant and equal to the original blank diameter (($P_t=\pi d_b$). The line B illustrates the change in transverse pitch (here referred to as rolling transverse pitch) at which the blank actually rolls where transverse pitch increases with actual rolling diameter as the blank advances through the tooling ($P_R=\pi d_{b-R}$). This constant change in transverse pitch clearly shows the requirement for changing the transverse pitch throughout the longitudinal extent of the thread roll die working face.

Figure 7:
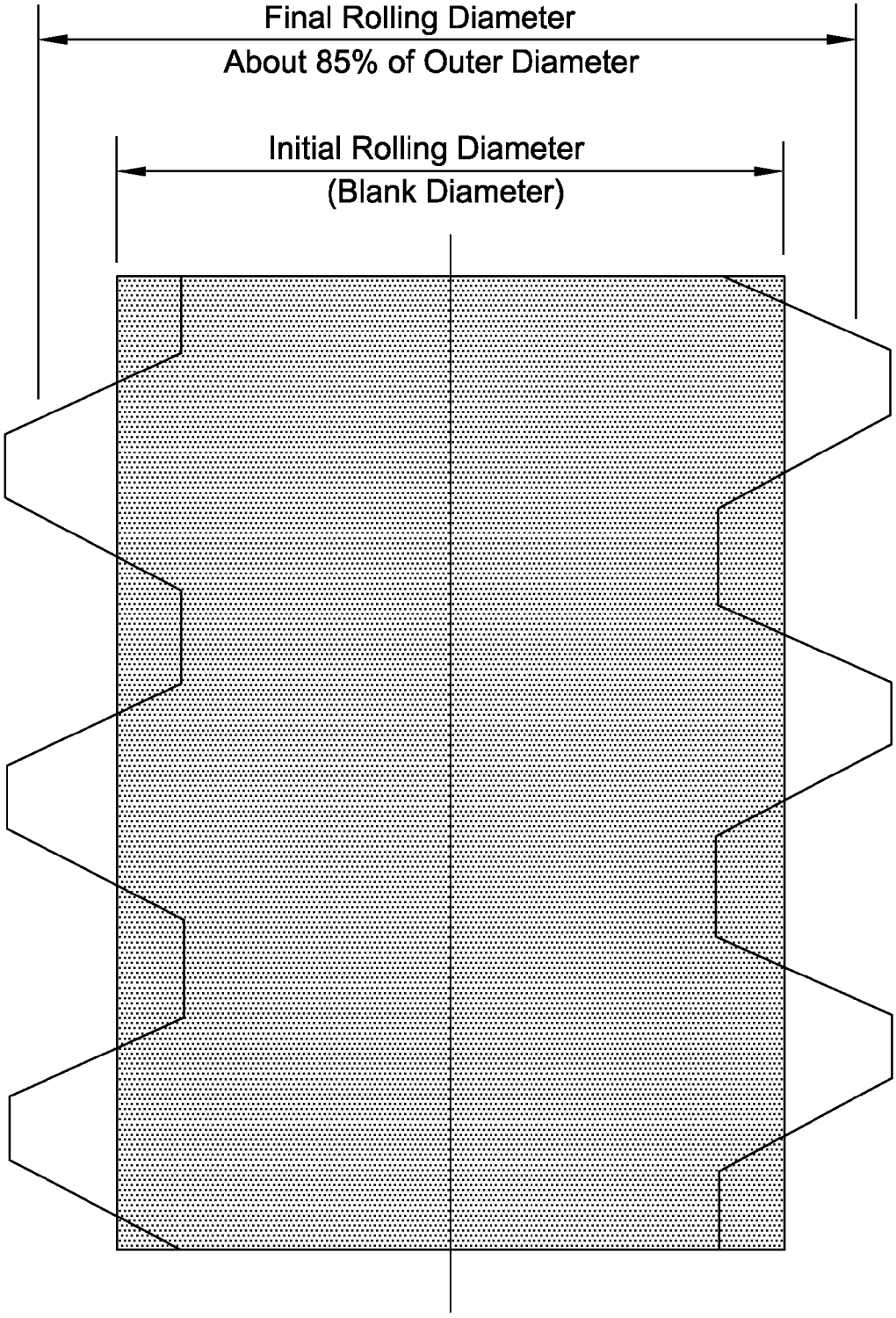
FIG. 7 is a schematic drawing illustrating the relationship between the rolling diameter of a threaded fastener and its final diameter.
Figure 10:
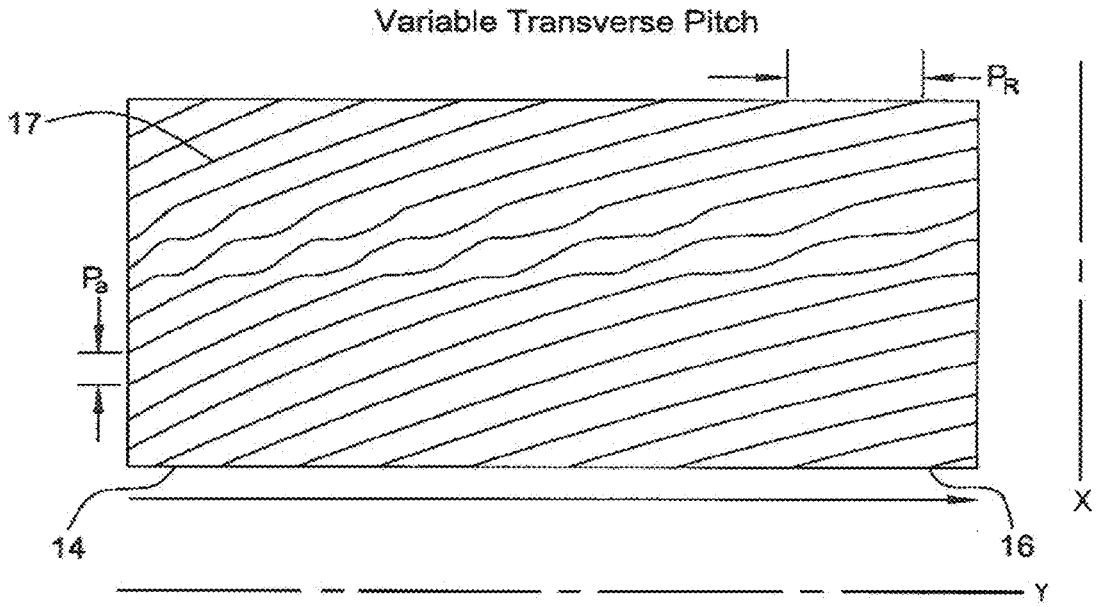
FIG. 10 is a plan view of a thread forming die of the present disclosure showing the relationship of the axial pitch and transverse pitch as disclosed herein.

A thread roll die made according to the invention illustrated in FIG. 10 is based on the known dimensions of the blank diameter and final outer diameter of the fastener. It is known that the final rolling diameter is 85% of the final diameter of the fastener. FIG. 7 illustrates the known relationship of the final rolling diameter to the outer diameter of the completed fastener. It is greater than the initial blank diameter and has been determined to be eighty-five percent (85%) of the final diameter of the fastener. Based on this relationship, the rolling transverse pitch $P_R$ for each revolution can be calculated, taking into account the desired number of rotations for the forming process. The rate of change depends on the number of rotations. The rolling transverse pitch between each revolution will slightly increase.

The rolling transverse pitch contemplated for the configuration shown in FIG. 10 is $P_R=\pi d_{b-R}$ where $d_{b-R}$ is the rolling diameter at any given location on the die face. Such a thread form on a die face is illustrated in FIG. 10. The spacing of adjacent thread forming elements such as crests 17 are spaced along the "X" axis the distance $P_a$ equal to the pitch of the thread being formed in the fastener blank. The spacing along the "Y" axis, is based on the ever-increasing rolling diameter. The rolling transverse pitch is ($P_R=\pi d_{b-R}$) where $d_{b-R}$ is the actual rolling diameter at a given position during the roll of the threads into the fastener.

Figure 9:
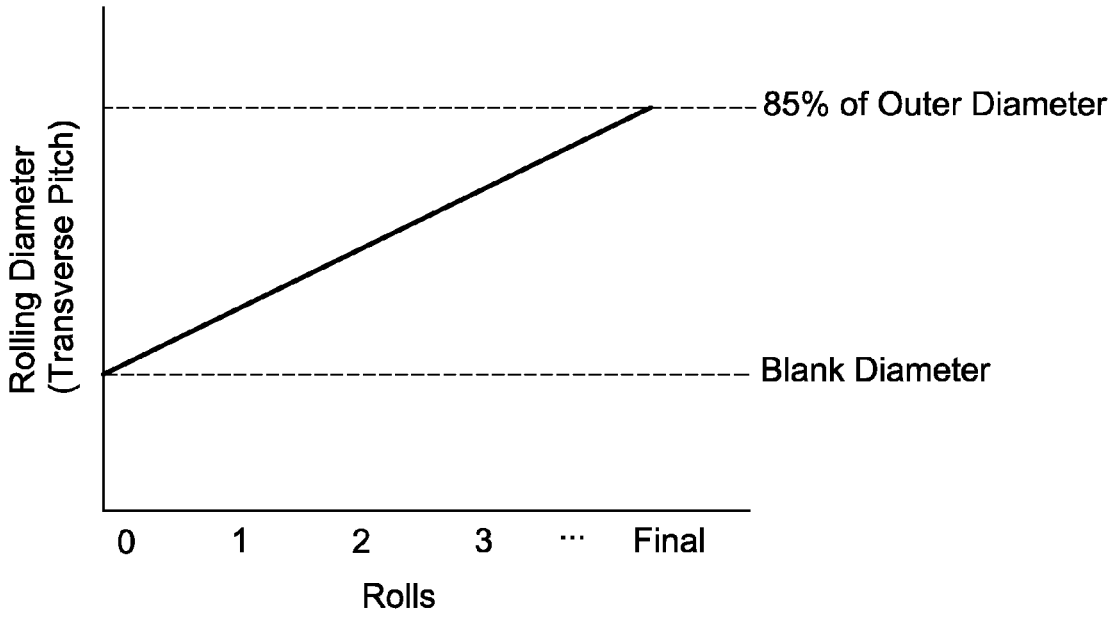
FIG. 9 is a chart illustrating the relationship between the transverse pitch of a thread formed on a threaded fastener and the number of rolls of a blank within a set of thread forming dies.

FIG. 9 is a chart that shows the linear relationship of the increase in rolling diameter from start to finish. As seen in FIG. 9, at the start end of the die the transverse rolling pitch ($P_R=\pi d_{b-R}$) is equal to the diameter of the blank. At the finish end, the transverse rolling pitch is equal to 85% of the outer diameter of the fastener.

It should be noted that the die thread forms on the die face are now curved. This curvature is attributable to the ever increasing dimension of the rolling diameter of the blank which increases as rolling progresses.

By ensuring proper die forming, better threads will be created and dies will last longer as they more properly align themselves during the rolling process. Proper alignment generates a lot less heat during the rolling process (friction), thereby resulting in longer life and better performance.

Of course, variations and modifications of the foregoing are within the scope of the present invention. Thus, it is to be understood that the invention disclosed and defined herein extends to all alternative combinations of two or more of the individual features mentioned or evident from the text and/or drawings. All of these different combinations constitute various alternative aspects of the present invention. The embodiments described herein explain the best modes known for practicing the invention and will enable others skilled in the art to utilize the invention. The claims are to be construed to include alternative embodiments and equivalents to the extent permitted by the prior art.

Variations and modifications of the foregoing are within the scope of the present invention. It is understood that the invention disclosed and defined herein extends to all alternative combinations of two or more of the individual features mentioned or evident from the text and/or drawings. All of these different combinations constitute various alternative aspects of the present invention. The embodiments described herein explain the best modes known for practicing the invention and will enable others skilled in the art to utilize the invention. The claims are to be construed to include alternative embodiments to the extent permitted by the prior art.

The invention claimed is:

1. A die for roll forming threads on a cylindrical blank, comprising, a generally planar die body having a longitudinally elongate working face extending from a start end of said die to a finish end of said die, said working face having a plurality of spaced apart thread forming elements extending across said entire working face spaced apart longitudinally of said die working face an ever increasing distance from the start end to the finish end measured along an axis "Y", in a pattern that extends across the entire longitudinal extent of the working face of said die wherein said thread forming elements on said working face of said die are spaced apart along said axis "Y" a distance equal to the transverse rolling pitch ($P_R=\pi d_{b-R}$) wherein $\pi d_{b-R}$ at said start end is equal to the diameter of the blank and $\pi d_{b-R}$ at said finish end is equal to eighty-five percent of the final outer diameter of the thread formed on the blank.

2. A die for roll forming threads on a cylindrical blank as claimed in claim 1 wherein said thread forming elements on said working face of said die are equally spaced along an axis "X" in a direction perpendicular to said longitudinal extent of said working face.

3. A die for roll forming threads on a cylindrical blank as claimed in claim 2 wherein said thread forming elements on said working face of said die are spaced apart along said axis "X" in a direction perpendicular to said longitudinal extent of said working face a distance equal to the axial pitch ($P_a$) of the thread formed on the blank.

4. A die for roll forming threads on a cylindrical blank as claimed in claim 1 wherein the change of the transverse rolling pitch from the start end to the finish end is linear.

5. A die for roll forming threads on a cylindrical blank as claimed in claim 4, wherein the rate of change of the transverse rolling pitch from the start end to the finish end is dependent upon the number of rotations of a blank between the start end and the finish end.

* * * * *